United States Patent [19]

Kaustrater

[11] Patent Number: 4,662,264

[45] Date of Patent: May 5, 1987

[54] ASSEMBLY FOR FEEDING AMMUNITION IN ARMORED VEHICLE

[75] Inventor: Gert Kaustrater, Augsburg, Fed. Rep. of Germany

[73] Assignee: Kuka Wehrtechnik GmbH, Augsburg, Fed. Rep. of Germany

[21] Appl. No.: 686,929

[22] Filed: Dec. 27, 1984

[30] Foreign Application Priority Data

Dec. 29, 1983 [DE] Fed. Rep. of Germany ..... 3347390
Mar. 29, 1984 [DE] Fed. Rep. of Germany ..... 3411555

[51] Int. Cl.[4] ..... F41F 9/00

[52] U.S. Cl. ..... 89/33.1; 89/34; 89/36.08; 89/36.13; 89/45; 89/46

[58] Field of Search ..... 89/33.1, 33.14, 33.16, 89/33.17, 34, 36.08, 36.13, 40.03, 45, 46

[56] References Cited

U.S. PATENT DOCUMENTS

| | | | |
|---|---|---|---|
| 607,681 | 7/1898 | Cochrane . | |
| 3,101,647 | 8/1963 | Greene . | |
| 4,092,900 | 6/1978 | Hottinger et al. | 89/33.1 |
| 4,318,331 | 3/1982 | Echtler et al. | 89/46 |
| 4,329,909 | 5/1982 | Tidstrom | 89/46 |
| 4,391,179 | 7/1983 | Tidstrom . | |
| 4,593,600 | 6/1986 | Kaustrater | 89/33.1 |

FOREIGN PATENT DOCUMENTS 3022410 5/1983 Fed. Rep. of Germany .

*Primary Examiner*—John F. Terapane
*Assistant Examiner*—Eric Jorgensen

[57] ABSTRACT

An assembly for feeding projectile ammunition in an armored vehicle equipped with a rotating turret and weapon carrier utilizes a mother container disposed within the vehicle below the feed port to the weapon carrier. The mother container is movable inwardly and outwardly of the vehicle through a feed door and includes a multiplicity of ammunition containers therewithin. The conveyor system for moving the ammunition containers is disposed within the mother container and is extensible therefrom through the port to move ammunition containers between the mother container and the weapon carrier. The mother container makes it possible to load at one time a number of filled reserve containers, together with their conveyor, after the mother container in use, possibly containing individual containers exhausted by firing, has been removed from the armored vehicle.

20 Claims, 9 Drawing Figures

ASSEMBLY FOR FEEDING AMMUNITION IN ARMORED VEHICLE

BACKGROUND OF THE INVENTION

The invention relates to an assembly for feeding projectile ammunition in an armored vehicle equipped with a rotating turret having a weapon carrier to which a cartridge magazine in the form of a container is detachably connected at some point about its rearward end, and having in its interior a container conveyor and a container reloading station positioned beneath a port in the armored roof so that, when the turret is rotated to an indexed position and the weapon carrier is elevated to an indexed position, the reloading station is aligned with the container connection located on the weapon carrier.

In such a mechanism as shown in German Patent Specification No. 30 22 410, filling the container conveyor is accomplished by consecutively loading filled reserve containers which are transported to the battle area by suitable ammunition vehicles. If there are exhausted containers in the container conveyor, these must first be removed individually before filled containers can be introduced to replace them. As a result, the entire process of munitioning is complicated, time-consuming and therefore dangerous. As will be appreciated, the situation is more dangerous the longer an armored vehicle remains stationary during munitioning and possibly combat-unready as well. Moreover, there is the loss in firepower due to longer breaks in combat necessitated by munitioning.

It is an object of the present invention to provide a novel assembly for storing and conveying ammunition containers in which the process of munitioning can be carried out more easily, quickly, and conveniently with a reduced degree of danger and, at the same time, reduced losses in firepower.

Another object is to provide such an assembly in which transport mechanism is self-contained within a mother container which is readily loaded and unloaded from the armored vehicle.

A further object is to provide such an assembly in which full containers are readily transported to the weapon carrier and moved therefrom into a storage position within the mother carrier.

SUMMARY OF THE INVENTION

It has now been found that the foregoing and related objects may be readily attained by building the entire container conveyor into a mother container which can be loaded into the armored vehicle through a closeable door in the side wall, the rear wall, or the roof of the latter.

The invention makes it possible to effect munitioning of an armored vehicle more or less exhausted of ammunition by quickly and easily replacing a single container, that is, a mother container carrying within itself the conveyor and a number of filled containers. The munitioning vehicle need only drive up to the armored vehicle requiring munitioning on the battle ground, remove the exhausted mother container through the door in the side wall, or rear wall, or roof of the armored vehicle, and load a new mother container filled with full containers to simply, quickly and conveniently make the armored vehicle again combat-ready.

In this connection it is advisable for the mother container to have above its reloading station a port, closable if desired, through which the containers can be transferred by the means of transport mechanism to the magazine attachment on the weapon carrier and, if desired, back again.

Two container reloading stations may be provided beneath two ports in the armored roof of the armored vehicle which are aligned with two magazine attachments on either side of the weapon carrier to which two containers can be detachably locked. Thus, the two containers may contain two different types of ammunition, e.g., explosive ammunition and armor-piercing or penetrating ammunition. In this case, it is desirable for two mother containers to be available, each loadable in the manner of a cassette into a holding device in the armored vehicle which pivots about a vertical axis. This is particularly advantageous when the mother containers are located behind the seats of the operating personnel so that they block passage to the rear. In this case, the ability of the mother containers to be swung about ensures for the operating personnel the possibility of moving into the rear section of the armored vehicle and, if necessary, exiting to the rear. In a preferred embodiment, the axis of each holding device is positioned near the vertical center plane of the armored vehicle in the rear corner area of a mother container. In this way, a mother container can be swung about 180° and shifted thereby to the rear of the other mother container, so that it is swung completely out of its previous operating position.

In the aforementioned design of German Specification No. 30 22 410, the container conveyor consists of a single linear and horizontal track section. According to the preferred embodiment of the present invention, the container conveyor consists of several track sections operatively connected together, at least two of which are at angles to each other and which need not be arranged in an exclusively horizontal configuration. It is advantageous for the container conveyor to consist of four track sections, of which two are positioned next to each other and essentially vertically, and two of which are positioned one above the other and essentially horizontally. By moving two vertical track sections as close together as possible, a substantial number of containers can be accommodated in the least possible space within a mother container. At the same time, the two vertical track sections are drawn close together, and each may carry several containers, e.g. three, one above the other. In this case, it is advantageous for one of the vertical track sections to be aligned beneath the port in the armored roof with the magazine attachment on the weapon carrier and to have the reloading station at its upper end.

DETAILED DESCRIPTION OF THE ILLUSTRATED EMBODIMENT

Figure 1:
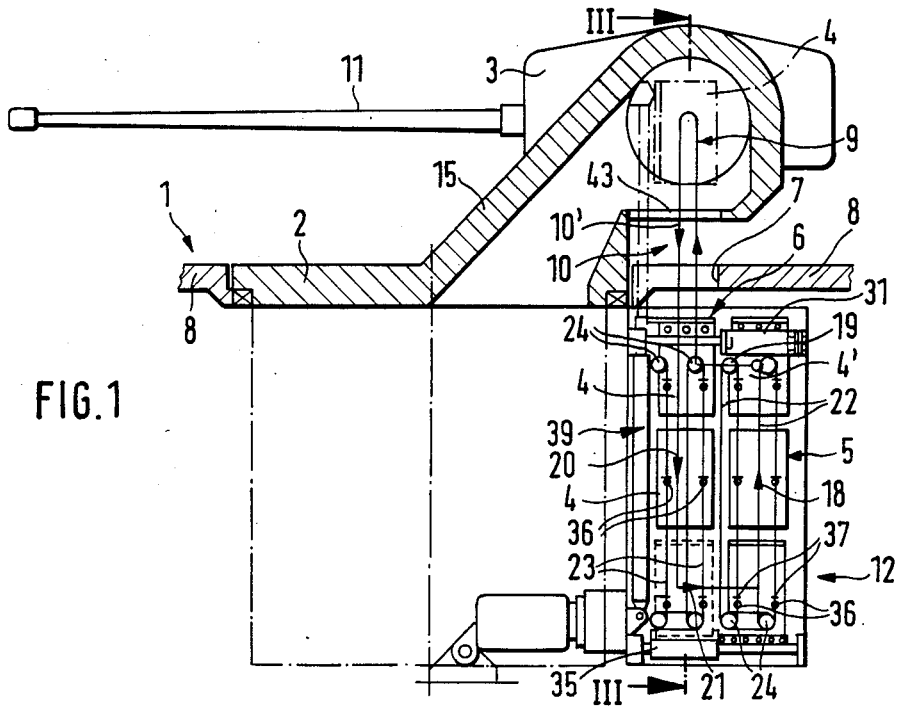
FIG. 1 is a fragmentary side view, in section, of a portion of an armored vehicle embodying the present invention.

In FIGS. 1-4, an armored vehicle is fragmentarily illustrated with a rotating turret 2 and a weapon carrier 3 which carries a cartridge magazine in the form of an ammunition container 4, detachably secured to a magazine attachment 9 thereon in a manner not illustrated but known in the prior art. In the embodiment shown, the container 4 can be mounted laterally on the weapon carrier, but it is understood that container 4 could also be mounted in any available position on the weapon carrier, e.g., below, behind, or above it.

Inside the armored vehicle is a container conveyor 5, along which is situated a container reloading station 6 beneath a port 7 in the armored roof 8 so that it is in alignment with the magazine attachment 9 on the weapon carrier when the turret 2 is rotated to an indexed position and the weapon carrier 3 is elevated (or lowered) to an indexed position. As can be seen from FIGS. 1 and 2, the two indexed positions are indicated by the longitudinal center plane 18' for the turret 2 (rotational position) and by zero elevation for the weapon carrier 3.

The space between reloading station 6 and magazine attachment 9 is bridged by a means of transport indicated in FIG. 1 by the two arrows 10, 10'. With the help of this means of transport 10, 10', each container 4 located in reloading station 6 can be moved upwardly to the magazine attachment 9, where the container 4 is mounted and delivers ammunition to the automatic weapon represented by weapon 11. If the container 4 in the position indicated in FIG. 1 by the broken line on weapon carrier 3 has been exhausted, it is returned by means of the transport 10, 10' to its original position, whereupon it makes room in the direction of arrow 20 so that container 4' can be moved into the reloading station 6, from there to be transferred by means of transport 10, 10'to the magazine attachment 9 and back.

According to the invention, the container conveyor 5 and reloading station 6 are provided within the mother container 12, which is loaded into armored vehicle 1 through a closeable feed door 13 in its side wall, rear wall, or roof. In the embodiment illustrated, the closeable door 13 is situated in the side wall 14 of vehicle 1.

Figure 3:
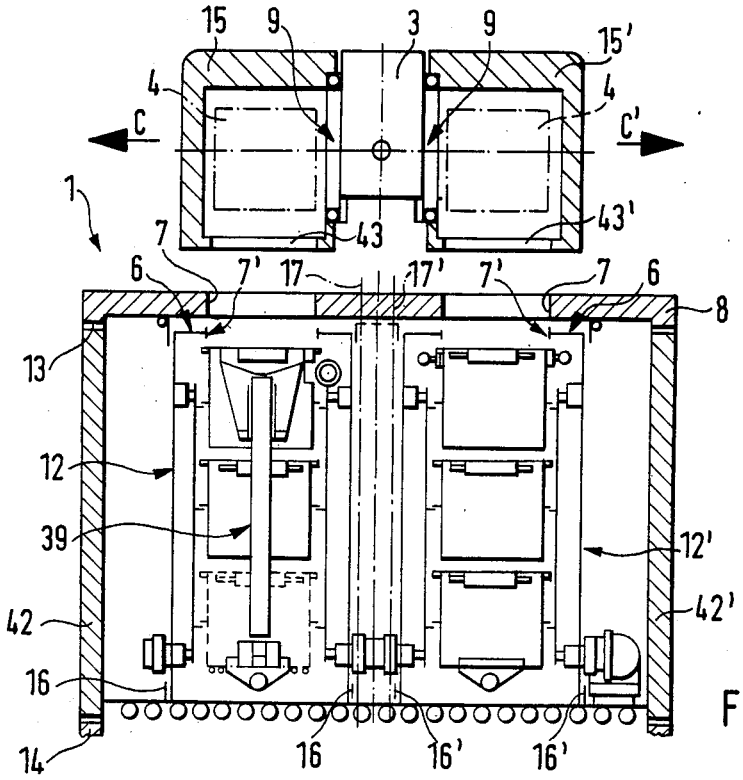
FIG. 3 is a sectional view along line III—III of FIG. 1.
Figure 5:
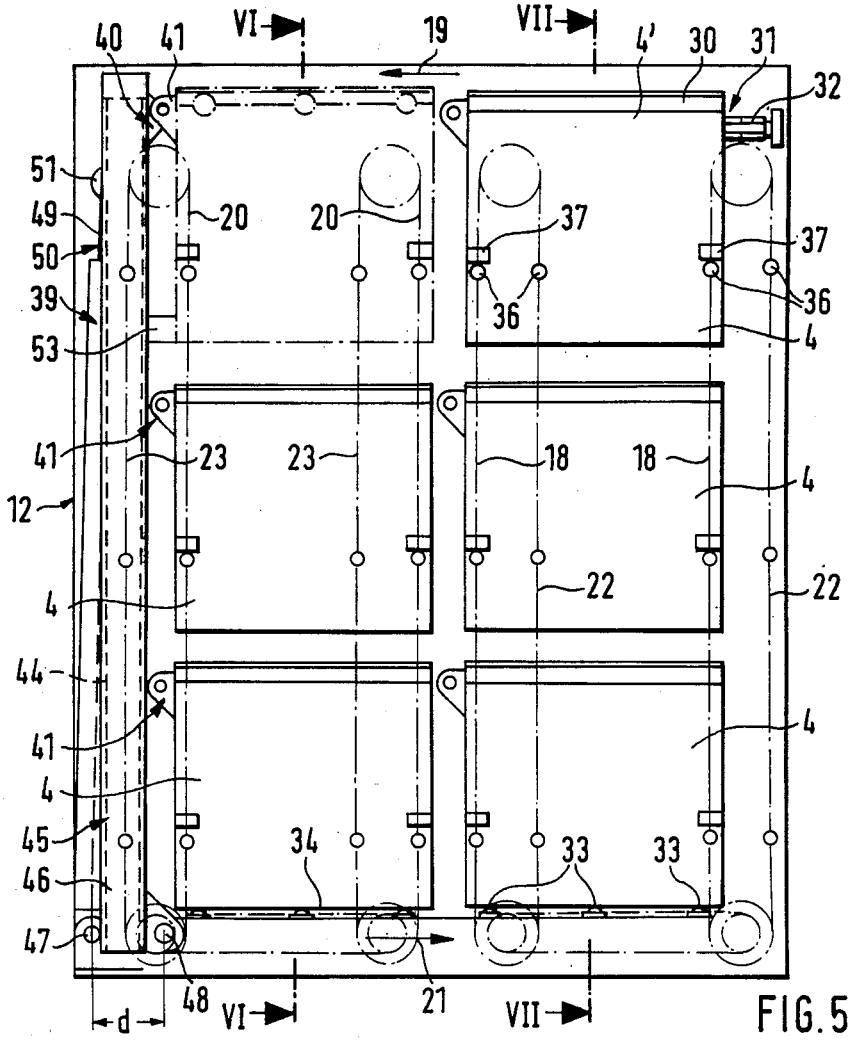
FIG. 5 is a vertical section through the mother container of FIG. 1.
Figure 5B:
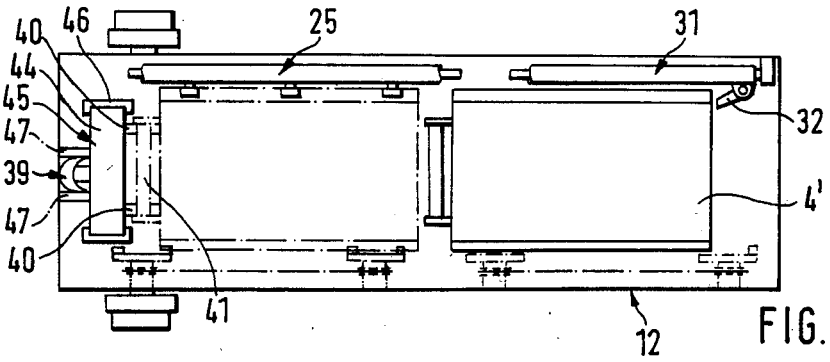
FIG. 5B is a top view of the mother container as seen in FIG. 5.

Each mother container 12 has in its top wall above its reloading station 6 a port 7', closeable if desired, for passage of a filled reserve container 4' to the magazine attachment 9 or of an exhausted container 4 back to the reloading station 6, as is illustrated in FIGS. 3 and 5.

In the preferred embodiment of the present invention, two ports 7 are provided in the armored roof 8 and two container reloading stations 6 are aligned with a pair of magazine attachments 9 located on either side of weapon carrier 3, and to which can be mounted detachably two containers 4. This is of particular advantage in the turret design shown, in which weapon carrier 3 is located between two shield cheeks 15, 15' on the armored turret 2. These shield cheeks 15, 15' at the same time protect magazine attachments 9 and containers 4, since they have ports 43, 43' only on their underside, and these ports are aligned with ports 7 in the armored roof 8 and therefore also with the reloading stations 6.

In this manner, two different types of ammunition can be brought at the same time to the weapon carrier 3 so that very rapid alternation of the ammunition being fired can be accomplished, or twice the amount of the same type of ammunition can be made available at the weapon carrier and thereby at the breech of the weapon.

Figure 2:
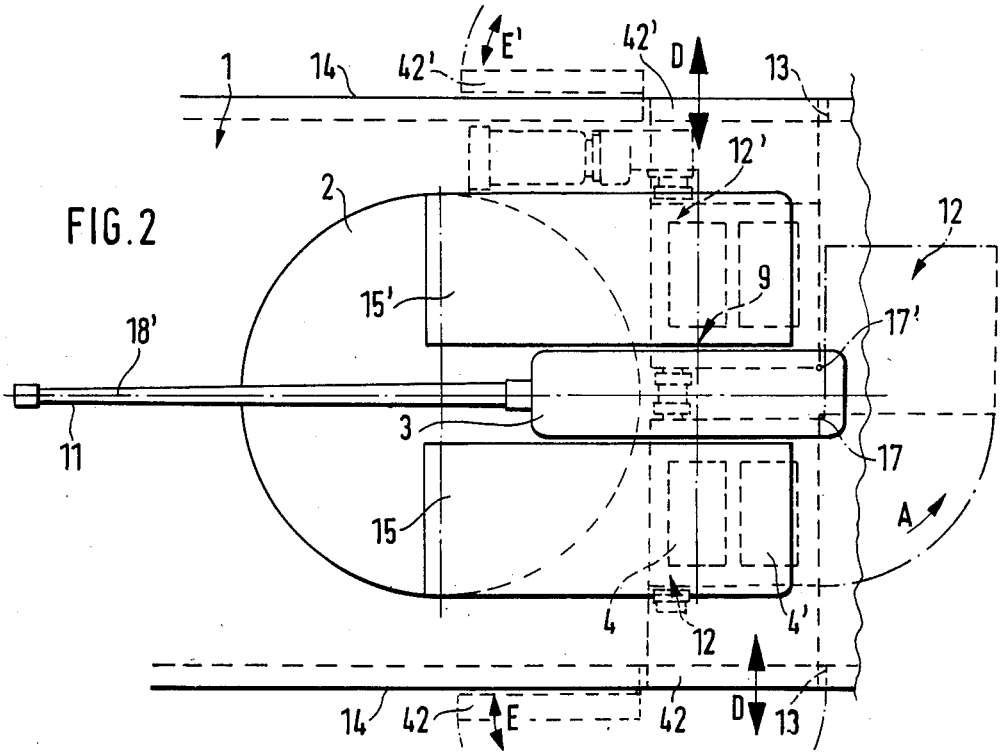
FIG. 2 is a top view of the vehicle in FIG. 1.

In this preferred embodiment, there are two mother containers 12, 12', each loaded in the manner of a cassette into a holding device 16, 16' within the armored vehicle 1. Each holding device 16, 16' pivots about a vertical axis 17, 17' which is positioned near the vertical center plane 18' of the armored vehicle 1 in the corner area of a mother container 12, 12' as seen in FIG. 2. As also seen in FIG. 2, the mother container 12 can be swung in the direction of arrow A into the position shown by the dashed line at the rear of the mother container 12'.

The container conveyor 5 preferably consists of several angularly connected track connections. In the preferred embodiment shown, it comprises four track sections 18, 19, 20 and 21, which are indicated in FIG. 1 by means of corresponding arrows. Here the two vertical track sections 18 and 20 are positioned next to each other and essentially parallel, and the two track sections 19 and 21 are situated one above the other adjacent the ends of the track sections 18 and 20, and essentially horizontal. The vertical track section 20 is located beneath the port 7 in the armored roof 8 in alignment in the position shown (indexed position) with its respective magazine attachment 9, and it has disposed at its upper end the reloading station 6. Each container 4 or 4' moves in a sliding or rolling manner on horizontal track sections 19, 21 and is raised or lowered on vertical track sections 18, 20. In the embodiment shown, the two horizontal track sections 19, 21 are roller conveyors, and the two vertical track sections 18, 20 are dual-chain conveyors 22, 23, which run in opposing directions continuously about corresponding chain sprockets 24.

Figure 6:
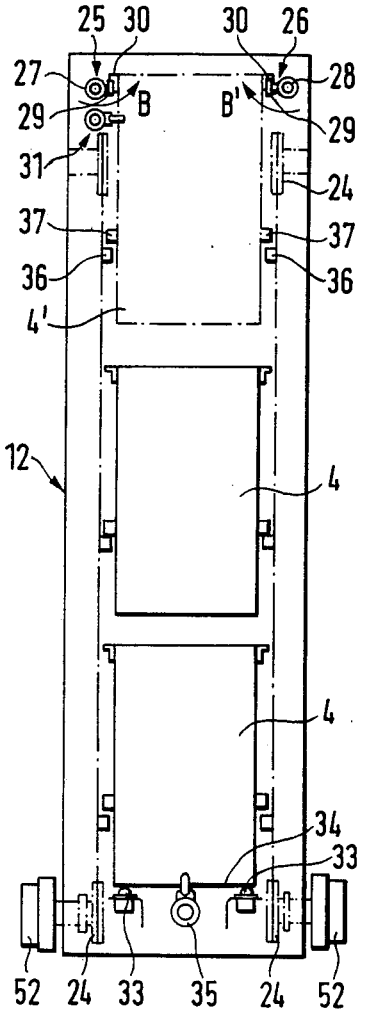
FIG. 6 is a sectional view along the line VI—VI of FIG. 5.
Figure 7:
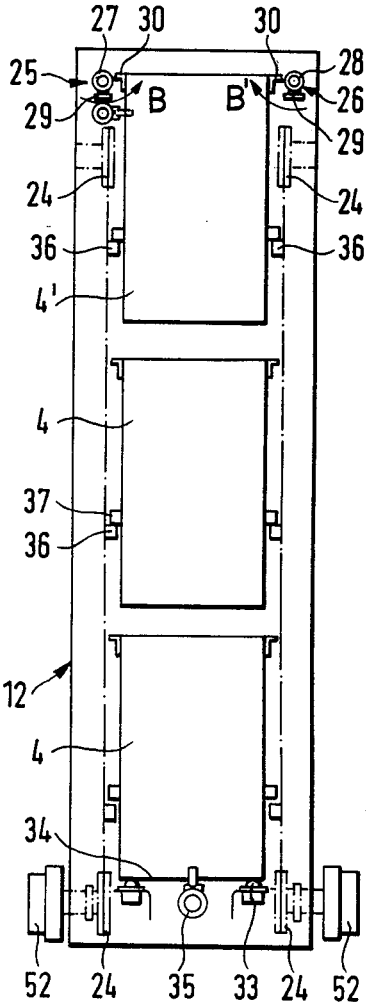
FIG. 7 is a sectional view along the line VII—VII of FIG. 5.

The upper roller conveyor 19 is formed with two roller guide rails 25, 26 positioned parallel to track section 19 as seen in FIGS. 5-7, and these swing inwardly and upwardly to position their rollers 29 against two support rails 30 located along the opposite sides of each container 4, 4'. Disposed parallel to the upper roller conveyor 19 is a reciprocating piston-cylinder unit 31 with a driver 32 that engages each container 4' for transporting the container 4' along the conveyor 19 to empty reloading station 6. The lower roller conveyor 21 consists of a number of ball casters 33 on which the bottoms of containers 4 are supported, and the container 4 are moved therealong by another reciprocating piston-cylinder unit 35.

Dual-chain conveyors 22, 23 have carriers 36 which cooperate with corresponding supports 37 on the sides of the containers 4 as seen in FIGS. 6 and 7 to grip them for vertical movement.

The longitudinal axes 27, 28 of the roller support rails 25,26 are situated in a plane lying above the plane in which the support rails 30 on a container 4, 4' are located when the latter is in its highest position on the corresponding carriers 36 of dual-chain conveyor 22, 23. Thus, when the roller support rails 25, 26 swing inwardly and upwardly in the direction of arrow B or B', the container 4 is raised from the corresponding carriers 36 on the dual-chain conveyor 22, 23 as seen in FIG. 6.

The means of transport 10, 10' for bridging the distance between the reloading station 6 and the magazine attachment 9 is, in the embodiment shown, a lifting piston-cylinder unit 39, positioned parallel to the vertical track section 20 for actuating an extensible grab hook 40 to engage a holding device 41 on the container 4. This will permit it to raise the container 4 (and then lower it after it is exhausted) through the port 7 of the armored roof 8 and through the port 7' in the mother container 12.

Figure 5A:
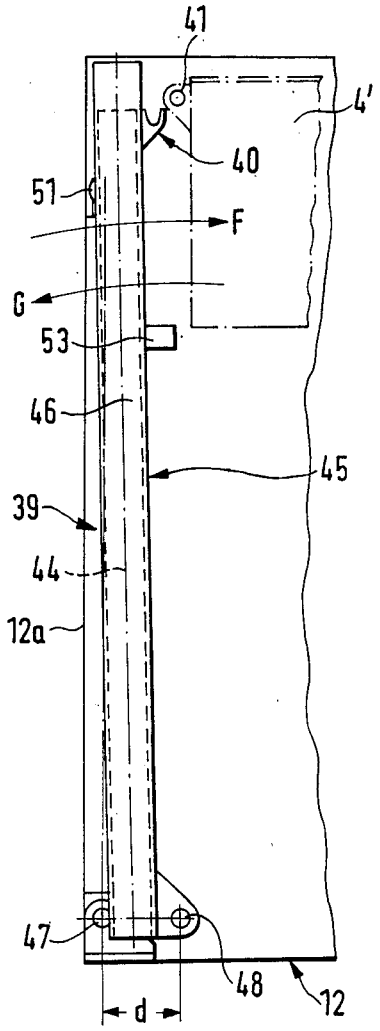
FIG. 5A is a fragmentary view of the mother container of FIG. 5 in a different operating position of the elements.

In the preferred embodiment shown, the lifting piston-cylinder unit 39 swings within the mother container 12, 12' about a first diagonal axis 47 in its base area as seen in FIGS. 5 and 5A. The grab hook 40 is situated at the upper end of the extending portion or element 44 of the telescopic support 45, which includes at least one guide element 46 that pivots about a second diagonal axis 48 positioned parallel to the first diagonal axis 47 and spaced a distance d therefrom. The free end 49 of the piston rod 50 of the lifting piston-cylinder unit 39 is coupled to the extending element 44 through a joint 51.

For the sake of clarity, the lifting piston-cylinder unit 39 representing the means of transport 10, 10' is only depicted in mother container 12 in FIGS. 3, 5, 5A, and 5B. However, it is understood that the same arrangement exists in the case of the mother container 12'.

The spacing d between the two diagonal axes 47 and 48 is selected so that the lifting piston-cylinder unit 39 and telescopic support 45 are in a position essentially parallel to the vertical track section 20, before the grab hook 40 comes into operative position to engage the holding device 41 on the container 4. During subsequent raising of the container 4', it is therefore supported by lug 53 and maintains the position shown during extension of the extending element 44 of the telescopic support 45 until it can be locked to the magazine attachment 9 of weapon carrier 3.

The adjacent wall 12*a* of the mother container 12 forms a stop for the lifting piston-cylinder unit 39 to prevent its inward pivoting or rotation in the direction G.

Turning now to the operation of the illustrated embodiment, a full container 4 located in the reloading station 6 is lifted by the telescopic support 45 of the lifting piston-cylinder unit 39, which is swung toward the container 4 to catch its holding device 41. The container 4 is moved through the ports 7, 7' and 43 into its position on magazine attachment 9 as indicated by the dashed lines, and it is attached to the weapon carrier 3. After container 4 is exhausted by firing, it is returned along the same path by the telescopic support 45 of the lifting piston-cylinder unit 39 until it is deposited by its supports 37 on the corresponding carriers 36 of dual-chain conveyor 23.

One position in the mother container 12 must always remain empty to enable the empty container 4 and the filled containers 4 beneath it to be transported downwardly by one station so that room can be made in reloading station 6 for the adjacent, filled reserve container 4'.

In the embodiment shown, six containers are provided in each mother container 12 or 12', with three positions located one above the other and two horizontally adjacent to each other in each case. The lowest position on the vertical track section 20 is vacant, so that the filled container 4 above it and relowered empty container 4 can be advanced downwardly by one position. The roller support rails 25, 26 then pivot about their longitudinal axes 27, 28 in the direction B or B' inwardly and upwardly so that their rollers 49 come into position against the support rails 30 on the container 4', as is shown in FIGS. 5–7. At the same time, the container 4' is raised and can be delivered by the piston-cylinder unit 31 and its driver 32 to the now empty reloading station 6. From this position, it can then be moved, after roller guide rails 25, 26 swing back, to the magazine attachment 9 in the manner heretofore described. The dual-chain conveyor 22 can come into action from this point on and transport the two containers 4 that it is still carrying, one position upwardly. This provides the second piston-cylinder unit 35 the opportunity to transfer the container 4 on dual-chain conveyor 23 resting on ball casters 33 to the delivery area for dual-chain conveyor 22.

As a result, the lowest position on the dual-chain conveyor 23 is free again so that, after exhaustion of the second container and its removal to the highest carriers 36 by its supports 37, the left dual-chain conveyor 23 can proceed upwardly one position to the reloading station 6 which is again free. The container 4' still resting on carriers 36 is represented in FIG. 7 by unbroken lines, while the container 4' lifted by roller guide rails 25, 26 is represented by broken lines in FIG. 6.

In FIG. 5, both positions are shown for clarity of illustration, although in reality only one position or the other is possible at any given time, since roller guide rails 25, 26 extend the entire length of track section 19.

The mother container 12, 12' can also be completely filled, i.e., each can have six individual containers. In this case, it should not be necessary to transfer every exhausted container 4, 4' back into the mother container. This is possible when the shield cheeks 15, 15' have lateral flaps (not shown) which can swing outwardly and permit the ejection of exhausted containers 4 or 4' in the direction of arrows C or C'. Then removal of the first container 4 from the loading station and freeing of a position within the mother container 12 or 12' permits further transport of the remaining containers 4 into the mother containers 12 or 12' on track sections 18–21 along conveyor 5 in the manner heretofore described.

Figure 4:
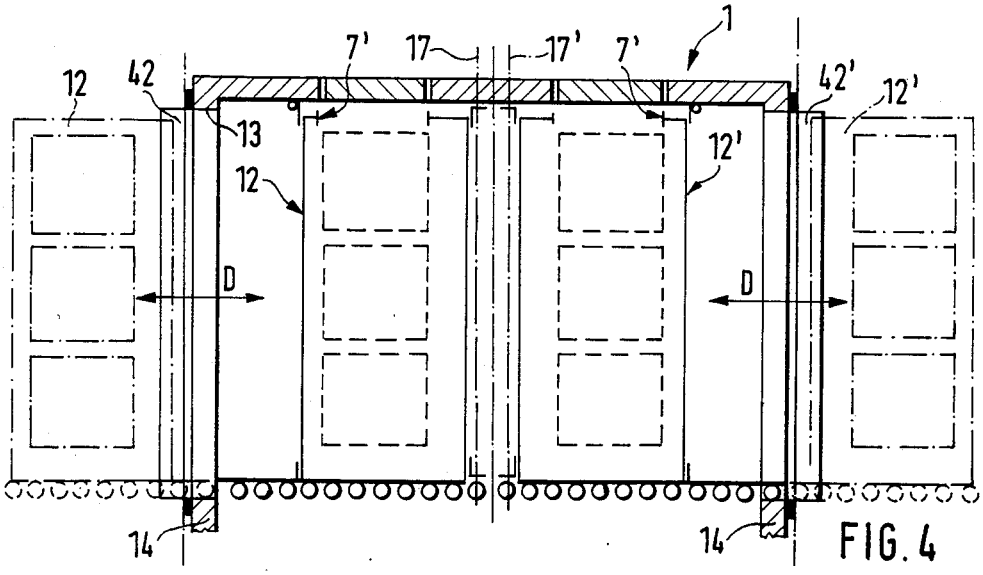
FIG. 4 is a sectional view similar to FIG. 3 and illustrating the loading, or removal of, the mother container.

Munitioning of armored vehicle 1 is shown clearly in FIGS. 2 and 4. Introduction and removal of the mother containers 12, 12' is shown by the direction of double headed arrows D. For this purpose it is only necessary for the corresponding doors 42, 42' to be swung outwardly in the direction of the double-headed arrows E and E', the doors 42, 42' may be closed again after introduction of filled mother containers 12, 12' and, if applicable, after previous removal of exhausted mother containers.

The piston-cylinder units 31 and 35 are employed in the manner described for moving containers 4, 4' on the track sections 19 and 21 on the roller guide rails 25, 26 or the ball casters 33. It is understood that in order to provide the hydraulic pressure required fittings or connections to a pressure source (not shown) are provided on the mother containers 12, 12' so that they can be connected to corresponding pressure source connections on the armored vehicle. In this fashion, the hydraulic system of the armored vehicle results will provide the motive force.

Driving the dual-chain conveyors 22, 23, is preferably carried out electrically by electric motors 52 as seen in FIGS. 6 and 7. It is understood that connections facilities must be provided on the mother containers 12, 12' to permit delivery of electrical power from the electrical system of the armored vehicle. The required hydraulic and electrical connections can be effected either by manually or automatically during or after introduction or loading of the mother containers 12, 12' into their holding devices 16, 16'.

Thus, it can be seen that the armored vehicle numition storage and feed assembly of the present invention enables rapid munitioning of the vehicle so that there is greater safety and less loss of firepower. Since the conveyor system is internal to the mother containers, time consuming conveyor repairs can be avoided.

Having thus described the invention, what is claimed is:

1. In an armored vehicle having a rotating turret with a weapon carrier having a weapon thereon and a magazine attachment on at least one side thereof, a reloading station in said vehicle below said weapon carrier, and a port in said vehicle between said reloading station and said weapon carrier at an indexed portion of said turret, the combination therewith of an assembly for storing and feeding projectile ammunition containers to said magazine attachment comprising:

A. a mother container in said armored vehicle below said turret;

B. a closeable feed door in an outer wall of said armored vehicle cooperatively dimensioned and configured to permit passage of said mother container therethrough for loading in said vehicle and removal therefrom;

C. a multiplicity of ammunition containers disposed in said mother container to supply projectile ammunition to said weapon upon movement to said magazine attachment, said containers each containing a multiplicity of projectile ammunition; and D. conveyor means in said mother container extensible upwardly from said mother container toward said reloading station for elevating said ammunition containers from said mother container to said reloading station and thereby effecting movement towards said magazine attachment.

2. The armored vehicle of claim 1 wherein said conveyor means includes a multiplicity of track sections, at least two connecting sections being disposed at an included angle of less than 180°.

3. The armored vehicle of claim 2 wherein there are four track sections, two of which are disposed substantially horizontally and two of which are disposed substantially vertically between said horizontal sections.

4. The armored vehicle of claim 3 wherein one of said vertical track sections is aligned beneath said port which is aligned with said magazine attachment in said indexed portion of said turret and wherein said reloading station is disposed at the upper end of said one vertical section.

5. The armored vehicle of claim 4 wherein said ammunition containers are movable horizontally on said horizontal track sections and vertically movable upwardly and downwardly on said vertical track sections.

6. The armored vehicle of claim 5 wherein said horizontal track sections are roller conveyors and said vertical track sections are double chain conveyors running in opposite directions.

7. The armored vehicle of claim 6 wherein the upper roller conveyor includes a pair of parallel roller guide rails which are movable towards and away from each other and wherein said ammunition containers have horizontally disposed support rails on opposite sides thereof engageable on said roller conveyors when said guide rails are moved towards each other.

8. The armored vehicle of claim 7 wherein the longitudinal axes of said roller guide rails of said upper roller conveyor are disposed in a plane above the horizontal plane in which said support rails of the ammunition container are disposed when an ammunition container is elevated to the highest position on said double chain conveyor so that pivoting of said roller guide rails inwardly and upwardly lifts the container from said carriers of said double chain conveyor.

9. The armored vehicle of claim 4 wherein there is included a piston/cylinder unit having its piston movable horizontally relative to the upper roller conveyor and a driver actuated thereby to move an ammunition container along the upper roller conveyor into or from said reloading station.

10. The armored vehicle of claim 6 wherein said lower roller conveyor includes a multiplicity of ball casters for movably supporting the bottom surface of said ammunition containers and wherein there is included a reciprocating piston/cylinder unit having its piston movable horizontally relative to said lower roller conveyor for movement of said containers horizontally therealong.

11. The armored vehicle of claim 6 wherein said chain conveyors have carriers thereon and said ammunition containers have supports thereon engageable by said carriers for vertical transport thereby.

12. The armored vehicle of claim 1 wherein said conveyor means includes a lifting cylinder/piston unit extending substantially vertically and disposed in alignment with said port and reloading station for engaging an ammunition container and extensible from said mother container to move the ammunition container vertically through said port and between said mother container and said magazine attachment.

13. The armored vehicle of claim 11 wherein said cylinder/piston unit includes a grab hook and wherein said ammunition containers have holding devices thereon engageable by said grab hook for said vertical movement thereof.

14. The armored vehicle of claim 13 wherein said lifting piston/cylinder unit pivots about a first axis extending transversely of and adjacent the base of said mother container.

15. The armored vehicle of claim 14 wherein said lifting piston cylinder unit includes a telescopic support with an extending portion and wherein said grab hook is disposed on said extending portion, said telescopic support having at least one guide element that pivots adjacent the base of said mother container about a second pivotal axis parallel to said first transversely extending axis and spaced a distance therefrom, the free end of the piston in said piston/cylinder unit being connected to said extending portion of said telescoping support at a joint.

16. The armored vehicle of claim 15 wherein the spacing between said transversely extending axes is dimensioned so that said piston and telescopic support interlock during pivoting in the direction of said ammunition containers within said mother container before engagement of said grab hook with the holding device on the ammunition container.

17. The armored vehicle of claim 16 wherein the adjacent wall of said mother container provides a stop surface to limit pivotal movement of said lifting piston/-cylinder unit in a direction away from said ammunition containers within said mother container.

18. The armored vehicle of claim 1 wherein said vehicle has a pair of said reloading stations therein and a pair feed ports to opposite sides of said weapon carrier, wherein said weapon carrier has a pair of said magazine attachments on opposite sides thereof, wherein a pair of said mother containers is provided in a compartment in said vehicle below said turret and said ports in said vehicle and into which said feed door provides access, and wherein there is included a pair of holding devices in said compartment for said mother containers in said vehicle, each of said holding devices being disposed in said compartment adjacent said feed door and being pivotable about a vertical axis for receipt and discharge of said mother containers through said feed door.

19. The armored vehicle of claim 18 wherein said vertical pivotal axes of said holding devices are disposed adjacent a vertical central plane extending through said compartment of said vehicle and adjacent the opposed sides of said pair of mother containers and adjacent the corners thereof which are disposed adjacent said feed door.

20. The armored vehicle of claim 1 wherein said mother container has an access opening in its upper surface and wherein there is included a closure for said port in said vehicle aligned with said reloading station.

* * * * *